United States Patent [19]

Menezes et al.

[11] Patent Number: 4,522,773

[45] Date of Patent: Jun. 11, 1985

[54] PROCESS FOR PRODUCING SELF-CRIMPING POLYESTER YARN

[75] Inventors: Edgar V. Menezes, Somerville, N.J.; John H. Southern, Pensacola, Fla.; Richard L. Ballman, Gulf Breeze, Fla.; J. M. Chamberlin, Pensacola, Fla.

[73] Assignee: Celanese Corporation, New York, N.Y.

[21] Appl. No.: 469,326

[22] Filed: Feb. 24, 1983

[51] Int. Cl.[3] ..... D02G 1/20

[52] U.S. Cl. ..... 264/167; 264/168; 264/177 F

[58] Field of Search ..... 264/168, 177 F, 210.8, 264/176 F, 167

[56] References Cited

U.S. PATENT DOCUMENTS

| | | | |
|---|---|---|---|
| 2,323,383 | 7/1943 | Dreyfus | 264/178 F |
| 3,053,611 | 9/1962 | Griehl | 264/176 F |
| 3,361,859 | 1/1968 | Cenzato | 264/176 F |
| 3,946,100 | 3/1976 | Davis et al. | 264/176 F |
| 3,969,462 | 7/1976 | Stofan | 264/176 F |
| 4,195,161 | 3/1980 | Davis et al. | 264/176 F |
| 4,332,757 | 6/1982 | Blackmon et al. | 264/177 F |
| 4,332,758 | 6/1982 | Blackmon et al. | 264/177 F |
| 4,338,275 | 7/1982 | Carr | 264/176 F |
| 4,351,147 | 9/1982 | Blackmon et al. | 264/177 F |
| 4,414,801 | 11/1983 | Blackmon et al. | 264/167 |
| 4,419,313 | 12/1983 | Bromley et al. | 264/167 |

FOREIGN PATENT DOCUMENTS

| | | | |
|---|---|---|---|
| 34880 | 9/1981 | European Pat. Off. | 264/176 F |
| 2117659 | 10/1972 | Fed. Rep. of Germany | 264/176 F |
| 42-22339 | 9/1968 | Japan | 264/176 F |
| 54-42415 | 12/1979 | Japan | 264/176 F |
| 357144 | 11/1961 | Switzerland . | |
| 530479 | 12/1972 | Switzerland . | |

*Primary Examiner*—James Lowe

*Attorney, Agent, or Firm*—S. M. Bodenheimer, Jr.

[57] ABSTRACT

Provided is a process for forming and modifying a self-crimping polyester yarn comprising a plurality of polyester filaments having thick and thin regions along their lengths which are out of phase from filament to filament. The plurality of filaments are produced by first forming a plurality of combined streams of molten melt spun polyester by combining at least first and second extruded molten streams of fiber forming polyester travelling at different extrusion speeds to thereby form thick and thin regions in the combined streams out of phase from other combined streams. The combined streams are then quenched and thereby transformed into solid filaments in a solidification zone provided with a gaseous atmosphere at a temperature below the glass transition temperature of the polyester. The resulting filaments are then passed in the direction of their lengths through a conditioning zone, which zone is provided with a gaseous atmosphere at a temperature sufficient to produce polyester filaments which exhibit a percent yarn shrinkage in the range of from about 10 to about 45 percent. The resulting filaments are withdrawn from the conditioning zone at a substantially constant wind-up speed.

The yarn thus obtained still exhibits a useful degree of crimp as well as properties similar to those observed in yarns spun at much higher wind-up speeds.

27 Claims, 7 Drawing Figures

Fig. 1
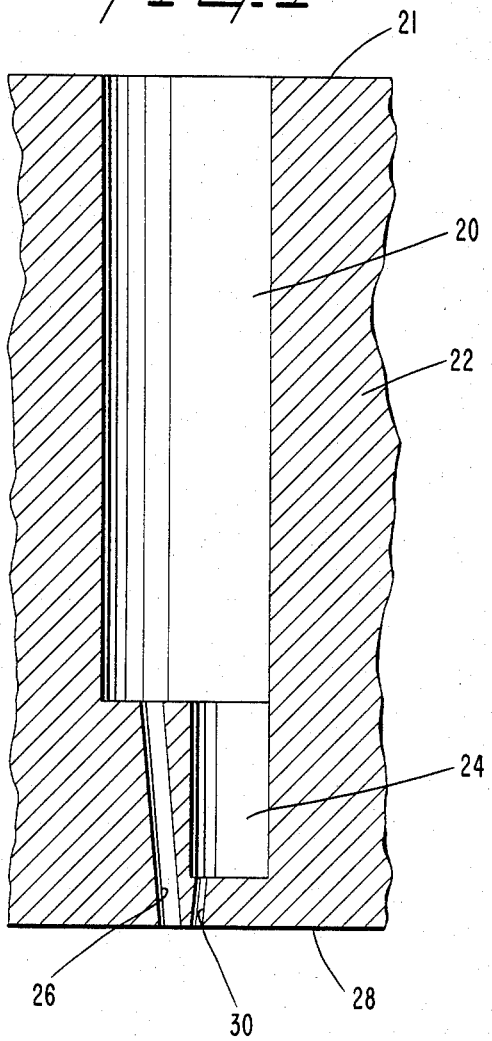
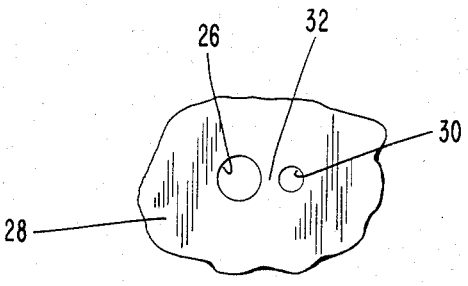
Fig. 2
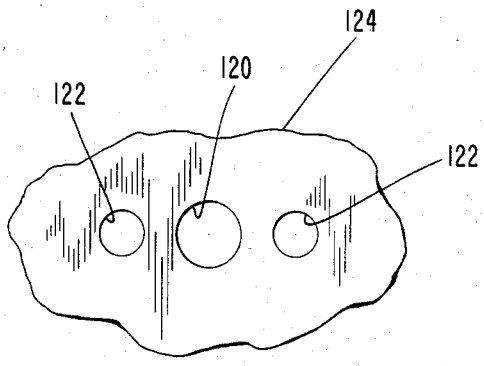
Fig. 3
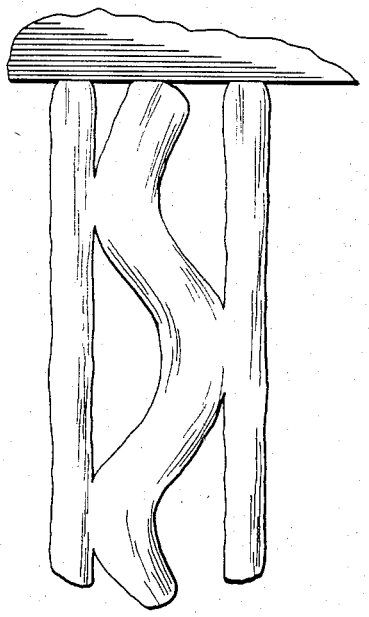
Fig. 4

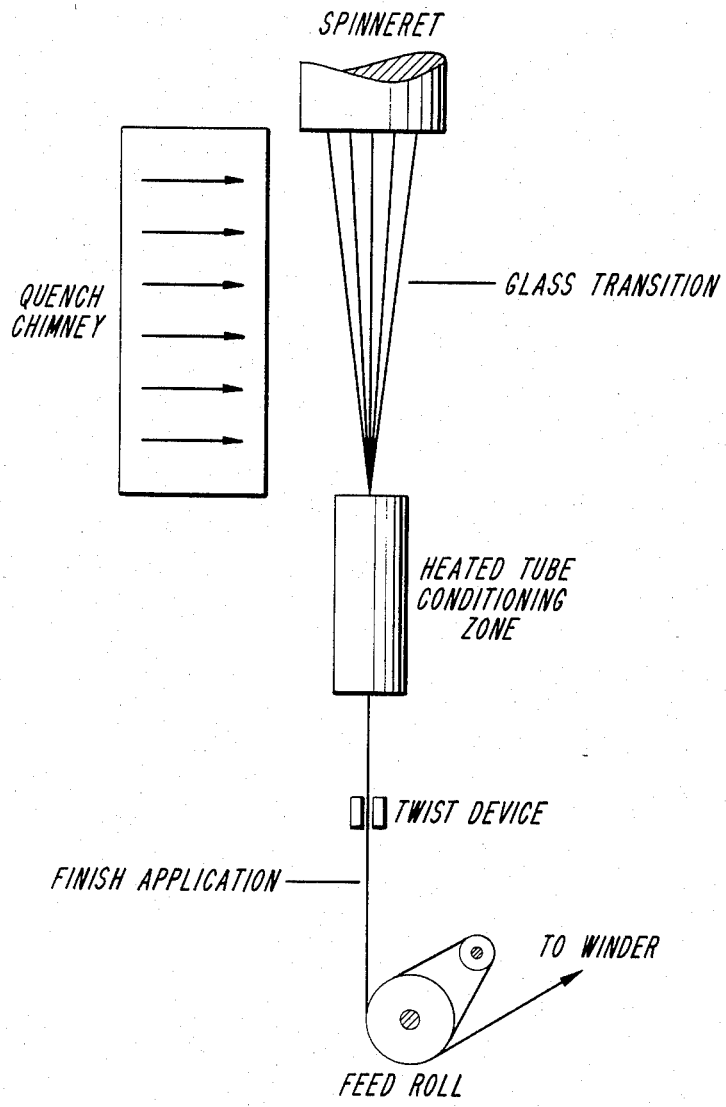
Fig. 5
Fig. 6
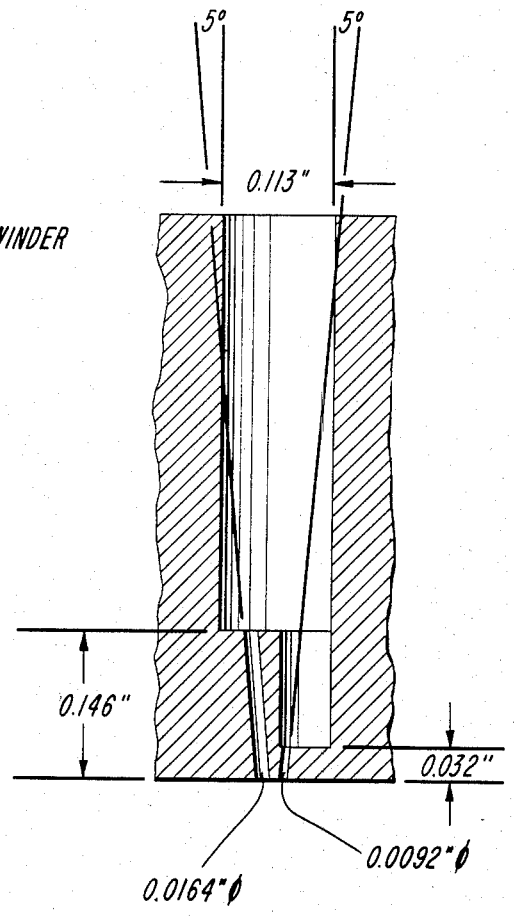

PROCESS FOR PRODUCING SELF-CRIMPING POLYESTER YARN

BACKGROUND OF THE INVENTION

1. Field of the Invention

The present invention relates to the preparation of self-crimping polyester yarn having a high wind-up speed structure at low wind-up speeds, e.g., commercial POY (partially oriented yarn) speeds. More particularly, the present invention relates to the melt spinning of self-crimping polyester yarn wherein extruded polyester filamentary material having high and low shrinkage regions along its length is passed through an annealing or conditioning zone subsequent to the material being quenched through its glass transition temperature under conditions such that the resulting yarn maintains its self-crimping properties and has a high speed structure.

2. Description of the Prior Art

Polymeric filamentary materials and films have been produced in the past under a variety of melt extrusion conditions. For example, both high stress and low stress spinning processes have been employed. Under high stress conditions the as-spun filamentary material is withdrawn from the spinneret under conditions whereby substantial orientation is imparted to the material soon after it is extruded and prior to its complete solidification. See, for instance, U.S. Pat. Nos. 2,604,667 and 2,604,689. Such high stress conditions of the prior art commonly yield a non-uniform filamentary material wherein substantial radial non-homogeneity exists across the fiber diameter leading frequently to less than desired tensile properties, or even self-crimping characteristics.

Melt spinning processes have also been proposed wherein the cooling of the extruded filamentary material has been retarded (i.e., prolonged) prior to complete solidification so as to alter the properties thereof. See, for instance, U.S. Pat. Nos. 2,323,383; 3,053,611; 3,361,859; and 3,969,462. Note also Swiss Pat. No. 357,144.

Moreover, U.S. Pat. No. 3,946,100, of common assignee, discloses a process for producing polymeric filamentary material or film of improved tensile strength and modulus and diminished shrinkage characteristics, wherein a thermal conditioning zone is employed after solidification of the melt spun filamentary material, but prior to wind-up. In the process, molten melt-spinnable polymeric material capable of undergoing crystallization, such as a polyester, is extruded through a shaped orifice to form a filamentary material or film, quenched to below its glass transition temperature to form a solid filamentary material or film, and then passed for a brief residence time through a thermal conditioning zone at a temperature between its glass transition temperature and its melting temperature wherein substantial crystallization of the previously solidified filamentary material takes place under high stress conditions. The filamentary material is then withdrawn from the thermal conditioning zone. Thereby, the birefringence and tensile properties of the filamentary material are increased and improved so much so that a conventional hot drawing step may be unnecessary. U.S. Pat. No. 4,195,161, also of common assignee, more fully describes the unique polyester fiber which is obtained thereby. A similar process for melt spinning filaments is disclosed in German Offenlegungschrift No. 2,117,659.

See also European application Ser. No. 0,034,880 and the patents discussed therein regarding melt spinning processes employing a thermal conditioning zone provided with a gaseous atmosphere at a temperature above the glass transition temperature of the filamentary material but below its melting temperature, through which the solidified filamentary material is passed prior to wind-up.

U.S. Pat. No. 4,338,275 relates to a draw spinning process for the manufacture of filamentary polyester yarns at increased spinning speeds without significant deterioration in yarn properties. The process is one in which freshly extruded filaments are passed sequentially through a first fluid environment heated to a temperature above the melting point of the filaments and a second fluid environment heated to a temperature above the glass transition temperature of the filaments, with subsequent winding up of the filaments at a speed in excess of 5500 meters/minute. The two environments are separated from one another by a short distance, advantageously by between 100 cm and 500 cm, which distance is selected so that it is sufficient to cool the fibers below the temperature of the second fluid environment. The resulting yarns are comparable in properties with conventional spin-lag-draw hot relax yarns.

In Swiss Pat. No. 530,479, there is disclosed a method for making three-dimensional curled yarns and fibers by melt-spinning synthetic linear polymers and employing drawing speeds of over 2,000 m/min. The process steps comprise first chilling the melt spun filaments directly below the spinneret on only one side, and then completely cooling the filaments to the coagulation point or below. The cooled filaments are then heated to a temperature above the coagulation point prior to wind-up.

The melt extrusion of polymeric filamentary material, and in particular polyester filaments, under extrusion conditions such that a plurality of melt spun filaments are merged to thereby provide a self-crimping yarn has also been attempted in the prior art.

For example, Japanese Patent Publication No. 22339/1967 discloses extruding at low spinning speeds various polymers through combined orifices, each combined orifice including a large diameter central capillary and two or more small diameter satellite capillaries, the lengths of the various capillaries being unspecified. The spun yarns are then drawn under unspecified conditions to yield drawn filaments having cross-sectional shapes which vary continuously and cyclically along the length of each filament.

It has been found, however, that in practicing the aforedescribed process the draw ratio may need to be reduced to an unusual ratio before the crimp level in the relaxed yarn increases to a marginally useful level.

Japanese Patent Publication No. 42,415/1979 discloses spinning two polyester streams through a spinneret with converging capillaries wherein the streams intersect in midair (below the spinneret) to form a combined stream. One of the streams has a higher speed than the other, and an oscillation occurs in the molten stream such that the combined stream, when quenched into a filament, exhibits thick and thin regions along its length. When a number of these filaments are combined into a yarn and relaxed, a highly useful degree of crimp is obtained, and fabrics made from the yarn have an unusual soft, luxuriant hand.

In U.S. Pat. No. 4,332,758 there is disclosed a process for producing a self-crimping yarn comprising first and second types of filaments, said process comprising spinning the first type by forming a first plurality of molten polyester streams having recurring thick and thin regions out of phase from stream to stream; quenching the first plurality of streams into the first type of filaments having thick and thin regions along their lengths and out of phase from filament to filament; spinning the second type by extruding other streams of molten polymer of fiber-forming molecular weight from helical orifices selected to give filaments with helical cross-sections and lower shrinkages than the combined filaments at a given common spinning speed; and quenching the other streams into filaments; withdrawing the first and the second types of filaments from the streams at the common spinning speed; and combining the first and the second types of filaments into a yarn; the thick and thin regions in the first plurality of molten streams and the common spinning speed being selected such that the yarn has a crimp of at least 2%.

It is generally very difficult to manipulate the melt extrusion conditions used in extruding such self-crimping yarn, however, in order to alter and/or improve the properties of the yarn while maintaining a useful degree of crimp. For in such self-crimping yarn, the filaments have high and low shrinkage regions spaced, preferably regularly, along their length. The degree of shrinkage amplitude variation of the various regions is extremely important for obtaining a useful degree of crimp. For example, if the degree of shrinkage amplitude variations are too small, or if the shrinkage amplitude variations along the filaments are in phase, a useful degree of crimp would not be obtained. If a treatment, for example, a heat treatment, during the melt extrusion process does not effect the merged filaments in a correct proportional manner, the self-crimping characteristics of the resulting filament would thereby be lost. This ability to condition or alter the properties of such a self-crimping yarn without losing the yarn's useful self-crimping characteristics, i.e., for example, in obtaining a high speed yarn at much lower spinning speeds, would be most desirable and of a great advantage to the art. A process enabling the art to achieve and realize such benefits, however, has heretofore not been known.

Accordingly, it is an object of the present invention to provide a melt extrusion process which alters or modifies the characteristics of a self-crimping yarn without losing the useful self-crimping characteristics thereof.

Another object of the present invention is to provide a process for achieving high wind-up speed characteristics in a self-crimping yarn without losing the useful self-crimping characteristics of the yarn and without having to use high wind-up speeds.

Still another object of the present invention is to provide a process which effectively yields a self-crimping yarn having a higher level of amorphous orientation than is otherwise possible with conventional POY wind-up speeds.

These and other objects, as well as the scope, nature and utilization of the invention, will be apparant to those skilled in the art from the following description and appended claims.

SUMMARY OF THE INVENTION

In accordance with the foregoing objects, provided is a process for expeditiously forming and structurally modifying a self-crimping polyester yarn comprising a plurality of polyester filaments having thick and thin regions along their lengths which are out of phase from filament to filament, which filaments are generated by the steps comprising:

(i) forming a plurality of combined streams of melt spun polyester by combining at least first and second extruded molten streams of fiber forming polyester travelling at different extrusion speeds to form thick and thin regions in the combined streams out of phase from other combined streams;

(ii) quenching the combined streams to thereby transform same into solid filaments having thick and thin regions along their lengths out of phase from filament to filament in a solidification zone provided with a gaseous atmosphere at a temperature below the glass transition temperature of the polyester;

(iii) passing the resulting filaments in the direction of their lengths through a conditioning zone provided with a gaseous atmosphere at a temperature sufficient to produce polyester filaments which exhibit a percent yarn shrinkage in the range of from about 10 to about 45 percent;

(iv) withdrawing the resulting filaments from the conditioning zone at a substantially constant wind-up speed. The yarn thus obtained still exhibits a useful degree of crimp, e.g., at least 2.5%, as well as properties similar to those observed in yarns spun at much higher wind-up speeds.

In a more specific embodiment of the present invention, there is provided such a process for forming and modifying a self-crimping polyester yarn wherein the filaments having thick and thin regions along their lengths are produced by:

(i) forming a plurality of combined streams of melt spun polyester by combining at least first and second extruded molten streams of fiber forming polyester travelling at different extrusion speeds to form thick and thin regions in the combined streams out of phase from other combined streams;

(ii) quenching the combined streams to thereby transform same into solid filaments having thick and thin regions along their lengths out of phase from filament to filament in a solidification zone provided with a gaseous atmosphere at a temperature below the glass transition temperature of the polyester;

(iii) passing the resulting filaments in the direction of their lengths through a conditioning zone provided with a gaseous atmosphere at a temperature in the range of from about 230° to about 270° C., and more preferably from about 240° to about 260° C.; and (iv) withdrawing the resulting filaments from the conditioning zone at a substantially constant wind-up speed in the range of from about 3500 to 4000 yards per minute, and more preferably about 3800 yards per minute.

BRIEF DESCRIPTION OF THE DRAWINGS

FIG. 1 is a vertical sectional view of a spinneret orifice;

FIG. 2 is a bottom plan view of the FIG. 1 orifice, looking up;

FIG. 3 is a plan view of the extrusion face of another spinneret orifice suitable for use in the present invention;

FIG. 4 is a schematic side view of the molten streams just below the face of the FIG. 3 spinneret;

FIG. 5 is a schematic depiction of the extrusion apparatus employed in the Example;

FIG. 6 is a vertical sectional view of a spinneret orifice of the spinneret employed in the Example.

DESCRIPTION OF THE PREFERRED EMBODIMENTS

Figure 7:
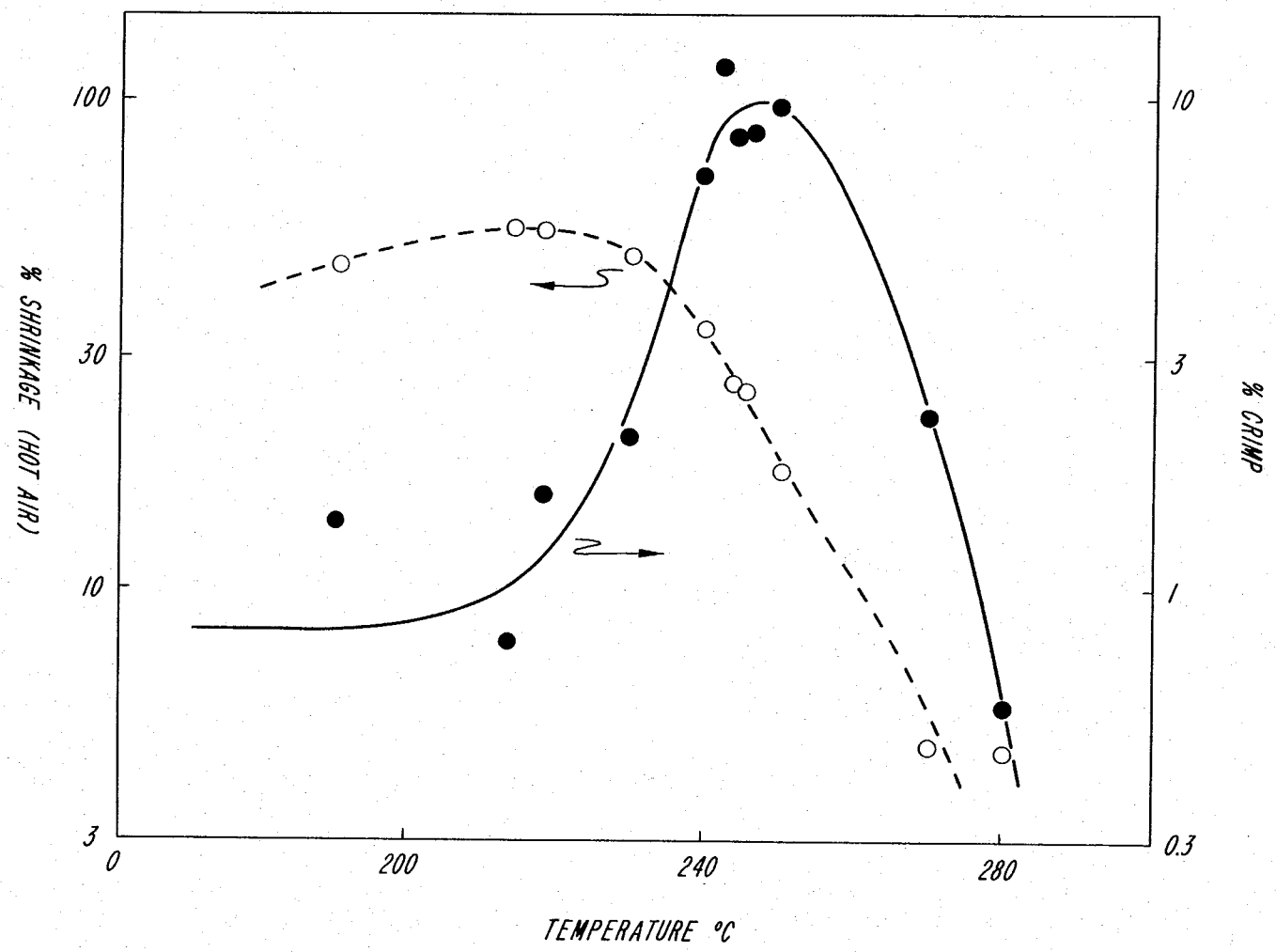
FIG. 7 is a graphical representation of the percentage crimp and shrinkage exhibited by a yarn with respect to the temperature of the gaseous medium in a conditioning zone.

The preferred polymeric materials for use in the present process are melt-spinnable polyesters. For instance, the melt-spinnable polyester selected for use in the present process may be principally polyethylene terephthalate, and preferably contains at least 75 mol percent polyethylene terephthalate, and most preferably at least 85 mol percent polyethylene terephthalate. In a particularly preferred embodiment of the process the melt-spinnable polyester is substantially all polyethylene terephthalate. Alternatively, during the preparation of the polyester minor amounts of one or more ester-forming ingredients other than ethylene glycol and terephthalic acid or its derivatives may be copolymerized. For instance, the melt-spinnable polyester may contain 75 to 100 mol percent (preferably 85 to 100 mol percent) polyethylene terephthalate structural units and 0 to 25 mol percent (preferably 0 to 15 mol percent) copolymerized ester units other than polyethylene terephthalate. Illustrative examples of other ester-forming ingredients which may be copolymerized with the polyethylene terephthalate units include glycols such as diethylene glycol, tetramethylene glycol, hexamethylene glycol, pentaerythitol, etc., and dicarboxylic acids such as hexahydroterephthalic acid, dibenzoic acid, adipic acid, sebacic acid, azelaic acid, etc.

The melt-spinnable polyethylene terephthalate selected for use in the process preferably exhibits an intrinsic viscosity, i.e., I.V., of about 0.45 to 1.0, and an I.V. of about 0.5 to 0.75 in a particularly preferred embodiment of the process. The I.V. of the melt-spinnable polyester may be conveniently determined by the equation $$IV = \lim_{c \to o} \left( \frac{\ln \eta r}{c} \right)$$

where $\eta r$ is the "relative viscosity" obtained by dividing the viscosity of a dilute solution of the polymer by the viscosity of the solvent employed (measured at the same temperature), and c is the polymer concentration in the solution expressed in grams/100 ml. The polyethylene terephthalate additionally commonly exhibits a glass transition temperature of about 60° to 80° C. and a melting point of about 250° to 265° C., e.g., about 260° C.

The polymer may also comprise conventional additives, such as, finely divided particulate fillers, e.g., $TiO_2$ and $SiO_2$, preferably in an amount ranging from 0 to about 10 weight percent, and most preferably in an amount ranging from 0 to about 1.5 weight percent based upon the total weight of polymer.

In extruding the polyester filaments of the present invention having thick and thin regions along their lengths which are out of phase from filament to filament, any conventional spinneret which allows for the forming of combined streams of molten polyester by combining at least first and second extruded streams of fiber forming polyester travelling at different extrusion speeds to thereby form thick and thin regions in the combined streams out of phase from other combined streams, may be used.

For example, FIGS. 1 and 2 illustrate a spinneret design which can be employed for obtaining the filaments according to the invention. For example, the spinneret includes a large counterbore 20 formed in the upper surface 21 of spinneret plate 22. Small counterbore 24 is formed in the bottom of and at one side of large counterbore 20. A large capillary 26 extends from the bottom of large counterbore 20 at the side opposite small counterbore 24, and connects the bottom of large counterbore 20 with the lower surface 28 of plate 22. Small capillary 30 connects the bottom of counterbore 24 with surface 28. Capillaries 26 and 30 are each inclined five degrees from the vertical, and thus have an included angle of ten degrees. Counterbore 20 has a diameter of 0.113 inch (2.87 mm.), while counterbore 24 has a diamater of 0.052 inch (1.32 mm.). Capillary 26 has a diameter of 0.016 inch (0.406 mm.) and a length of 0.146 inch (3.71 mm.), while capillary 30 has a diameter of 0.009 inch (0.229 mm.) and a length of 0.032 inch (0.812 mm.). Land 32 separates capillaries 26 and 30 as they emerge at surface 28, and has a width of 0.0043 inch (0.109 mm.). Plate 22 has a thickness of 0.554 inch (14.07 mm.). Capillaries 26 and 30 together with counterbores 20 and 24 constitute a combined orifice for spinning the various filaments according to the invention.

When polyester polymer is spun through the aforediscussed exemplary combined orifice, a remarkable phenomenon occurs due to the geometry of the spinneret construction, the polymer flowing through the smaller capillaries 30 has a higher velocity than that flowing through the large capillaries. The speeds and momenta of the paired streams issuing from each combined orifice and the angle at which the streams converge outside the spinneret are such that the slower streams travel in substantially straight lines after the points at which the paired streams first touch and attach, while each of the smaller and faster of the streams forms sinuous loops back and forth between successive points of attachment with its associated larger streams. This action can be readily observed using a stroboscopic light directed onto the stream immediately below the spinneret face. As the molten streams accelerate away from the spinneret, the slower stream attenuates between the points of attachment and the loops of the faster stream become straightened until the faster stream is brought into continuous contact with the slower stream. The slower stream attenuates more between than at the points of first attachment, so that the resulting combined stream has a cross-section which is larger at the points of first attachment than in the regions between these points. The resulting combined stream is then further attenuated somewhat until it is solidified into a filament in a solidification zone.

A spinneret employing substantially parallel capillaries may also be employed in spinning a self-crimping yarn. A minimum of two such parallel capillaries in combination are needed to attain a filament with thick and thin regions. However, combinations of three or more capillaries may also be successfully employed.

For example, as shown in FIGS. 3 and 4, polyester polymer may be melt spun through substantially parallel capillaries 120 and 122 in spinneret 124 to provide at least two molten substreams, one of which has a higher velocity than the other. The capillaries are spaced laterally a small distance selected such that the sub-streams unite below the spinneret into a combined stream having thick and thin regions. For example, in a preferred embodiment, capillary 120 may have a diameter of 0.305 mm. while satellite capillaries 122 have diameters of 0.203 mm., the centers of capillaries 122 being 0.356 mm. from the center of and located on opposite sides of capillary 120, all capillaries being 0.305 mm. in length. Capillary 120 and its associated satellite capillaries 122 cooperate as a combined orifice for spinning a single filament, schematically shown in FIG. 4. Ordinarily, a plurality of combined orifices will be provided in a single spinneret so that the resulting multifilament yarn comprises more than one of the filaments according to the invention.

It is essential that one of the sub-streams have a higher velocity than at least one other of the sub-streams which unite to form a combined stream. FIG. 4 illustrates qualitatively the resulting action of the molten sub-streams immediately below the spinneret specifically described above. Since all the capillaries in this instance are the same length, the sub-stream issuing from capillary 120 has a higher velocity upon extrusion than the sub-streams issuing from capillaries 122. The center substream accordingly alternately strikes and bonds to one of the outer sub-streams, then buckles and strikes and bonds to the other of the outer sub-streams. The combined stream thus formed is attenuated and the various sub-streams unite side-by-side to form a stream having thick and thin regions along its length.

In general, the spinneret is advantageously so designed that one of the individual streams has a velocity in its capillary between 2.0 and 7 times (preferably between 3.5 and 5.5 times) the velocity of one of the other streams in its capillary. Further advantages are obtained when the faster of the two streams has a smaller cross-sectional area than the slower of the streams, particularly in degree of crimp and spinning stability.

Subsequent to extrusion, the resulting molten combined streams are passed in the direction of their length through a solidification zone provided with a gaseous atmosphere at a temperature below the glass transition temperature of the polyester, wherein the molten material is transformed to a solid filamentary material. When the material is principally polyethylene terephthalate, the gaseous atmosphere of the solidification zone is generally provided at a temperature below about 80° C.

Within the solidification zone the molten material passes from the melt to a semi-solid consistency, and from the semi-solid consistency to a solid consistency. The solidification zone could also be termed a "quench zone." The gaseous atmosphere present within the solidification zone preferably circulates so as to bring about more efficient heat transfer. In a preferred embodiment of the process the gaseous atmosphere of the solidification zone is provided at a temperature of about 10° to 40° C., and most preferaby at about room temperature (e.g., at about 25° C.). The chemical composition of the gaseous atmosphere is not critical to the operation of the process provided the gaseous atmosphere is not unduly reactive with the polymeric material. In a particularly preferred embodiment of the process the gaseous atmosphere of the solidification zone is air. Other representative gaseous atmospheres which may be selected for utilization in the solidification zone include inert gases such as helium, argon and nitrogen.

The solidification zone is preferably disposed immediately below the spinneret. Commonly, the solidification zone possesses a length of about 0.25 to 20 feet, and preferably a length of about 1 to 7 feet. The gaseous atmosphere is also preferably introduced at the lower end of the solidification zone and withdrawn along the side thereof with the moving continuous length of polymeric material passing downwardly therethrough from the spinneret. A center flow quench or any other technique capable of bringing about the desired quenching may be alternatively utilized.

The resulting solid filaments are next passed in the direction of their length through a conditioning zone provided with a gaseous atmosphere at a temperature above the glass transition temperature but below the melting point of the polyester filaments. The temperature of the gaseous atmosphere is at a temperature sufficient to produce polyester filaments which exhibit a percent yarn shrinkage in the range of from about 10 to 45 percent, more preferably in the range of from about 15 to 35 percent, and most preferably in the range of from about 20 to about 30 percent. Employment of a gaseous atmosphere at the aforedescribed sufficient temperature is important, for otherwise it has been found that the self-crimping characteristics of the yarn filaments are substantially lessened to such a degree that a useful degree of crimp cannot be obtained, e.g., about 2.5% or more. More particularly, if the zone temperature is too low, a high shrinkage/low crimp yarn such as is usually termed POY is obtained, and if the zone temperature is too high, a low shrinkage/low crimp flat yarn is obtained.

This is believed to be the case, for substantial crystallization of the solidified material is believed to take place in the conditioning zone. The crimping mechanism of a self-crimping yarn produced in accordance with the present invention is believed to stem from the varying shrinkage along the length of the various filaments making up the yarn. This varying shrinkage arises from the thick and thin sections in the filaments experiencing different stress levels, and hence, possessing different levels of crystallinity. When such yarn is heated under low tension, the high shrinkage regions in a filament contract more than the low shrinkage regions in adjacent filaments, which are forced to bulge out and protrude from the yarn bundle, yielding crimp. If substantial crystallization takes place the shrinkage variation might be lost between the thick and thin regions, and if the degree in shrinkage variations were lost, or even became too small between the thick and thin sections of the yarn, a useful degree of crimp would not be obtained. Surprisingly, however, by employing a gaseous atmosphere at a temperature sufficient to produce filaments which exhibit a percent yarn shrinkage per the present invention, the filament structure is found to be modified without losing the self-crimping characteristics thereof. Employment of temperature conditions outside of those of the present invention, however, have been found to result in yarn exhibiting less than useful self-crimping characteristics, i.e., less than about 2.5 percent.

The temperature of the gaseous atmosphere in the conditioning zone required to attain the desired yarn shrinkage, and hence the desired overall properties including percentage crimp, will vary depending upon the wind-up speed (and hence residence time) employed. As the wind-up speed is increased somewhat substantially, e.g. an increase of 500 ypm, so must the temperature of the gaseous atmosphere be increased to attain the same level of shrinkage. When a wind-up speed is in the range of from about 3500 to 4000 yards per minute (about 3180–3635 meters per minute) and more preferably about 3700 to 3900 ypm, a gaseous temperature in the range of from about 230° to about 270° C. is generally preferred, with a gaseous temperature in the range of from about 240° to 260° C. being most preferred, for attaining a yarn exhibiting a crimp of at least 5%.

The chemical composition of the gaseous atmosphere provided within the conditioning zone is not critical to the operation of the process provided the gaseous atmosphere is not unduly reactive with the polymeric filamentary material. Static air or steam may conveniently be selected. Other representative gaseous atmospheres which may be employed in the conditioning zone include atmospheres comprising unit gases such as helium, argon and nitrogen. Band heaters or any other heating means may be provided so as to maintain the conditioning zone at the required temperature. The conditioning zone commonly has a length of about 0.5 to 30 feet, and preferably a length of about 3 to 12 feet.

The resulting filamentary material is then withdrawn from the conditioning zone at a substantially constant wind-up speed. The speed preferably ranges from about 2200 to 4400 yards per minute (2000 to 4000 meters per minute), and most preferably is in the range of from about 3500 to 4000 yards per minute.

Each resulting filament has non-round cross-sectional areas which vary repetitively along its length, the regions of large area having much higher shrinkage than those of small area. Due to minor differences between combined orifices, temperature gradations across the spinneret, and other like deviations from exactly the same treatment for each pair of streams, a multiple orifice spinneret will typically provide somewhat different repetition rates among the several resulting streams and filaments.

The improved melt extrusion process of the present invention may be conveniently carried out in conventional melt spinning equipment, e.g., nylon spinning equipment, which is provided with a spinneret suitable for melt spinning a self-crimping yarn. A heated conditioning chamber of adequate length may then be simply added thereto below the quench zone.

The process of the present invention provides one with a method for expeditiously obtaining a self-crimpable polyester yarn which will exhibit a useful degree of crimp, as well as properties of higher speed yarn. For example, self-crimping yarn spun in accordance with the present invention at a wind-up speed of about 3800 yards per minute has been found to exhibit essentially similar property levels as self-crimping yarn melt spun under essentially the same conditions, except for the conditioning zone, but at a wind-up speed of 5000 yards per minute. In particular, the percentage crimp and amorphous orientation were similar. Moreover, fabrics woven from the yarns were similar in their properties of air permeability, opacity, drape and hand.

Thus, one can expeditiously achieve via the present invention a self-crimping product having a useful degree of crimp and high wind-up speed properties at significantly lower wind-up speeds. The present invention would, therefore, find particular significance in dealing with winders of limited speed. For example, when certain property levels in self-crimping yarns are desired which generally can only be achieved through the use of new high speed winders, such property levels could be achieved through the use of older equipment via the utilization of the present invention. The economic advantages associated with the present invention are therefore significant.

The following example is given as a specific illustration of the present invention. It should be understood, however, that the specific details set forth in the example are merely illustrative and are in no-manner meant to be limitative.

In the following example, and for the purpose of the present invention, the yarn properties are determined in the following manner.

A 1 and $\frac{1}{8}$ meter circumference skein of approximately 8000 skein denier is prepared from the yarn to be tested using a Suter denier reel or equivalent. The length $L_0$ of the skein is measured while the skein is supporting a weight equal to 0.0025 grams per skein denier. The skein with the weight suspended therefrom is placed in a hot air oven maintained at 120° C. for 5 minutes. The skein is then removed from the oven and conditioned for 1 minute at 21° C. and 65% relative humidity, after which the skein length $L_1$ is determined. The weight is then increased to provide a loading of 0.1 grams per skein denier, and 30 seconds thereafter the skein length $L_2$ is determined. Yarn percent shrinkage is accordingly defined as $100(L_0-L_2)/L_0$, and yarn percent crimp development is defined as $100(L_2-L_1)/L_2$. Yarn percent bulk is defined as $100(L_0-L_1)/L_0$.

The percent elongation and tenacity (g/den) were measured with an Instron tensile tester using a gage length of 12.5 cm., and a rate of extension of 30 cm per minute. Each sample was measured five times.

Amorphous orientation (fa) is the measurement of the alignment of the polymer chain axis with respect to the fiber axis in the amorphous region and was determined in accordance with the formula $$fa = 1 - \frac{E_a^\circ}{(1 - X_c)} \quad \frac{1.5}{E} - \frac{X_c(1 - fc)}{E_c^\circ},$$

wherein E is the sonic modulus in dynes/cm$^2$; $E_a^0$ and $E_c^0$ are intrinsic lateral moduli of the amorphous and crystalline phases as defined by Dumbleton et al in "The Effect of Structural Changes on Dye Diffusion in Poly(ethylene) Terephthalate", *J. Appl. Poly. Sci.*, volume 12, pp. 2491–2508 (1968); and, fc is the crystalline orientation number, i.e., a measure of polymer chain axis alignment in the crystalline phase, with $$fc = 1 - 3/2 \langle \sin^2 \theta \rangle,$$

wherein $\theta$ is the angle the polymer chain axis makes with the fiber axis.

The percent crystallinity was determined in accordance with the following derived equation:

$$\%\ \text{crystallinity} = 0.027 + \frac{0.970}{\%\ \text{shrinkage}}$$

EXAMPLE

In Runs 1–13, various self-crimpable polyester yarns were melt spun using the set-up schematically depicted in FIG. 5 with the spinneret shown in FIG. 6. The polyester was a polyethylene terephthalate containing about 1.25 mole percent diethylene glycol and 1.0 wt. percent $TiO_2$, and having an inherent viscosity of 0.67. The molten polyester was extruded through the spinneret and quenched in a solidification zone (quench chimney) wherein a transverse air flow of either 75 or 350 cubic feet per meter was used to quench the molten filamentary material to a solid filamentary material. The solid filaments were then passed through a heated tube which was 1 meter in length and had an inner diameter of 2 cm. The tube was made of stainless steel, contained an air atmosphere, and was resistance heated by a variac transformer arrangement. The temperature of the air atmosphere was varied from 190° to 280° C. for the various runs.

A pneumatic twist device was placed about 1.2 m from the bottom of the heated tube in order to substantially reduce any filament motion in the tube. 1.5 m from the bottom of the heated tube a conventional oil finish was applied to the yarn. The wind-up speed employed was consistently about 3800 yards per minute.

The properties of the various samples of yarn obtained were measured as previously described. The results are tabulated in the following Table. The variation of shrinkage and percentage crimp vs. heated tube temperature is schematically plotted in FIG. 7.

TABLE

| Run No. | Temp. of Cond. Zone (°C.) | Quench Air Flow (cfm) | % Crystal. | Amorph. Orient. | % Bulk | % Shrink | % Crimp | % Elong. | Tenacity (g/den) | Spin Speed (ypm) |
|---|---|---|---|---|---|---|---|---|---|---|
| 1 | 200 | 75 | 13.91 | 0.697 | 12.50 | 10.17 | 2.58 | 45.82 | 2.76 | 3800 |
| 2 | 240 | | 32.02 | 0.719 | 13.05 | 10.37 | 2.99 | 43.56 | 2.87 | 3800 |
| 3 | 280 | | 31.43 | 0.744 | 5.18 | 4.65 | 0.56 | 41.98 | 3.18 | 3800 |
| 4 | 190 | | 10.98 | 0.374 | 46.86 | 46.15 | 1.32 | 80.58 | 1.93 | 3800 |
| 5 | 214 | 350 | 10.29 | 0.528 | 55.45 | 55.09 | 0.79 | 46.38 | 1.77 | 3800 |
| 6 | 230 | | 9.28 | 0.605 | 46.19 | 48.12 | 2.06 | 41.19 | 2.06 | 3800 |
| 7 | 240 | | 10.97 | 0.638 | 38.99 | 34.34 | 7.08 | 42.89 | 2.34 | 3800 |
| 8 | 250 | | 13.60 | 0.667 | 25.35 | 17.14 | 9.91 | 42.21 | 2.25 | 3800 |
| 9 | 242 | | 17.32 | 0.655 | 30.71 | 21.42 | 11.81 | 42.88 | 2.42 | 3800 |
| 10 | 218 | | — | — | 54.91 | 54.20 | 1.56 | — | — | 3800 |
| 11 | 244 | | — | — | 32.73 | 26.47 | 8.51 | — | — | 3800 |
| 12 | 246 | | — | — | 32.20 | 25.76 | 8.67 | — | — | 3800 |
| 13 | 270 | | — | — | 6.79 | 4.65 | 2.25 | — | — | 3800 |
| 14 | — | | 13.39 | 0.575 | 41.25 | 36.07 | 8.08 | 52.57 | 2.40 | 4800 |
| 15 | — | | 16.20 | 0.600 | 35.30 | 28.78 | 9.11 | 51.86 | 2.50 | 5000 |
| 16 | — | | 20.19 | 0.623 | 31.01 | 20.89 | 9.93 | 55.24 | 2.87 | 5200 |

As can be seen from FIG. 7, a useful degree of crimp was only generally obtained in the heated tube temperature range of from about 230° to 270° C. Outside this range, the crimping properties of the yarn were less than desirable, i.e., less than about 2.5 percent.

Moreover, by comparing the above results with Runs 14–16 of the Table, which were run in accordance with the aforedescribed procedure except that no heated tube was used and spinning speeds of from 4800–5200 yards per minute were used, one will observe that the amorphous orientation, percent of crimp, percent shrinkage, percent bulk and tenacity are comparable, particularly when the heated tube was at a temperature of about 240° C. to 250° C., wherein the % yarn shrinkage of the filaments produced was within the range of from 15 to 35 percent. Thus, it can be seen that by employing the process of the present invention, one can obtain a useful self-crimping yarn also having properties similar or comparable to those exhibited by a self-crimping yarn melt spun at a much higher spinning speed.

Although the invention has been described with preferred embodiments, it is to be understood that variations and modifications may be resorted to as will be apparent to those skilled in the art. Such variations and modifications are to be considered within the purview and the scope of the claims appended hereto.

We claim:

1. A process for expeditiously forming and structurally modifying a latently self-crimping polyester yarn comprising a plurality of polyester filaments having thick and thin regions along their lengths which are out of phase from filament to filament, which filaments are generated by the steps comprising:

(i) forming a plurality of combined streams of melt spun polyester by combining at least first and second extruded molten streams of fiber forming polyester travelling at different extrusion speeds to form thick and thin regions in the combined streams out of phase from other combined streams:

(ii) quenching the combined streams to thereby transform same into solid filaments having thick and thin regions along their lengths out of phase from filament to filament in a solidification zone provided with a gaseous atmosphere at a temperature below the glass transition temperature of the polyester;

(iii) passing the resulting filaments in the direction of their lengths through a conditioning zone provided with a gaseous atmosphere at a temperature sufficient to decrease the percentage yarn shrinkage of said resulting filaments and to produce polyester filaments which exhibit a percentage yarn shrinkage in the range of from about 10 to about 45 percent; and (iv) withdrawing the resulting filaments from the conditioning zone at a substantially constant wind-up speed in the range of from about 2200 to about 4400 yards per minute.

2. The process of claim 1, wherein the temperature of the gaseous atmosphere in the conditioning zone is sufficient to produce a percentage yarn shrinkage in the range of from 20 to 30 percent.

3. The process of claim 1, wherein the temperature in the conditioning zone is in the range of from about 230° C. to about 270° C.

4. The process of claim 3, wherein the temperature in the conditioning zone is in the range of from about 240° C. to about 260° C.

5. The process of claim 3, wherein the wind-up speed employed is about 3800 yards per minute.

6. The process of claim 1, wherein said fiber-forming polyester comprises from 85 to 100 mol percent polyethylene terephthalate and from 0 to 15 mol percent of copolymerized ester units other than polyethylene terephthalate.

7. The process of claim 1, wherein said fiber-forming polyester is substantially all polyethylene terephthalate.

8. The process of claim 1, wherein the gaseous atmosphere in the solidification zone is provided at a temperature in the range of from about 10° to 40° C.

9. The process of claim 1, wherein the gaseous atmosphere in the solidification zone is air.

10. The process of claim 1, wherein the gaseous atmosphere in the conditioning zone is air.

11. The process of claim 1, wherein the spinning speed, velocities and lateral spacing upon extrusion are such that the thick and thin regions along the filaments are regularly spaced.

12. The process of claim 1, wherein the self-crimping polyester yarn exhibits a crimp of at least about 5 percent.

13. The process of claim 1, wherein said first stream is larger than said second stream.

14. The process of claim 1, wherein said first stream has a velocity between 2 and 7 times the velocity of said second stream.

15. The process of claim 1, wherein the molten streams are extruded from substantially parallel spinneret capillaries with the capillaries being laterally spaced a small distance selected such that said first and second streams unite below the spinneret.

16. A process for expeditiously forming and structurally modifying a latently self-crimping polyester yarn comprising a plurality of polyester filaments having thick and thin regions along their lengths out of phase from filament to filament, which filaments are generated by the steps comprising:

(i) forming a plurality of combined streams of melt spun polyester by combining at least first and second extruded molten streams of fiber forming polyester travelling at different extrusion speeds to form thick and thin regions in the combined streams out of phase from other combined streams;

(ii) quenching the combined streams into solid filaments having thick and thin regions along their lengths out of phase from filament to filament in a solidification zone provided with a gaseous atmosphere at a temperature below the glass transition temperature of the polyester;

(iii) passing the resulting filaments in the direction of their lengths through a conditioning zone provided with a gaseous atmosphere at a temperature in the range of from about 230° to about 270° C.; and then (iv) withdrawing the resulting filaments from the conditioning zone at a substantially constant wind-up speed in the range of about 3500 to 4000 yards per minute.

17. The process of claim 16, wherein the molten streams are extruded from substantially parallel spinneret capillaries with the capillaries being laterally spaced a small distance selected such that said first and second streams unite below the spinneret.

18. The process of claim 16, wherein the temperature in the conditioning zone is in the range of from about 240° C. to about 260° C.

19. The process of claim 16, wherein the wind-up speed is about 3800 yards per minute.

20. The process of claim 16, wherein said fiber-forming polyester comprises from 85 to 100 mol percent polyethylene terephthalate and from 0 to 15 mol percent of copolymerized ester units other than polyethylene terephthalate.

21. The process of claim 16, wherein the fiber-forming polyester is substantially all polyethylene terephthalate.

22. The process of claim 16, wherein the gaseous atmosphere in the solidification zone is provided at a temperature in the range of from about 10° to 40° C.

23. The process of claim 16, wherein the gaseous atmosphere in the solidification zone is air.

24. The process of claim 16, wherein the gaseous atmosphere in the conditioning zone is air.

25. The process of claim 16, wherein the self-crimping polyester yarn exhibits a crimp of at least 2.5 percent.

26. The process of claim 16, wherein said first stream has a velocity between 2 and 7 times the velocity of said second stream.

27. A process for forming a latently self-crimping polyester yarn comprising a plurality of polyester filaments having thick and thin regions along their lengths out of phase from filament to filament and exhibiting a crimp of at least 2.5 percent, which filaments are produced by the steps comprising:

(i) forming a plurality of combined streams of melt spun polyester by combining at least first and second extruded molten streams of fiber forming polyester comprising substantially all polyethylene terephthalate, which streams are extruded from substantially parallel spinneret capillaries with the first stream having from 2 to 7 times the velocity of the second stream and with the capillaries being spaced laterally a small distance selected such that the first and second streams unite below the spinneret into combined streams having thick and thin regions;

(ii) quenching the combined streams into solid filaments in a solidification zone provided with a gaseous atmosphere at a temperature below the glass transition temperature of the polyester;

(iii) passing the resulting filaments in the direction of their lengths through a conditioning zone provided with a gaseous atmosphere at a temperature sufficient to produce polyester filaments which exhibit a percent yarn shrinkage in the range of from about 10 to 45 percent; and (iv) withdrawing the resulting filaments from the conditioning zone at a substantially constant wind-up speed.

* * * * *